US010273801B2

(12) United States Patent
Shah et al.

(10) Patent No.: US 10,273,801 B2
(45) Date of Patent: Apr. 30, 2019

(54) METHODS AND SYSTEMS FOR DOWNHOLE SENSING AND COMMUNICATIONS IN GAS LIFT WELLS

(71) Applicant: General Electric Company, Schenectady, NY (US)

(72) Inventors: Vimal Vinod Shah, Sugar Land, TX (US); Stewart Blake Brazil, Edmond, OK (US); Wilson Chun-Ling Chin, Edmond, OK (US); Roderick Mark Lusted, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 1 day.

(21) Appl. No.: 15/603,093

(22) Filed: May 23, 2017

(65) Prior Publication Data

US 2018/0340413 A1 Nov. 29, 2018

(51) Int. Cl.

| | |
|---|---|
| ***E21B 47/18*** | (2012.01) |
| ***E21B 41/00*** | (2006.01) |
| ***E21B 43/12*** | (2006.01) |
| ***F01D 21/00*** | (2006.01) |
| *F01D 15/10* | (2006.01) |

(52) U.S. Cl.

CPC ..... *E21B 47/18* (2013.01); *E21B 41/0085* (2013.01); *E21B 43/123* (2013.01); *F01D 21/00* (2013.01); *F01D 15/10* (2013.01)

(58) Field of Classification Search

CPC .... E21B 47/18; E21B 41/0085; E21B 43/123; E21D 15/10; E21D 21/00

See application file for complete search history.

(56) References Cited

U.S. PATENT DOCUMENTS

RE30,055 E 7/1979 Claycomb
5,207,272 A * 5/1993 Pringle ..... E21B 17/06 166/120

(Continued)

FOREIGN PATENT DOCUMENTS

WO 03041282 A2 5/2003
WO 2004/085796 A1 10/2004

OTHER PUBLICATIONS

Tong et al., "A Plunger Lift and Monitoring System for Gas Wells Based on Deployment-Retrievement Integration" Natural Gas Industry B, vol. 2, Issue: 5, pp. 449-454,Nov. 2015.

(Continued)

*Primary Examiner* — D. Andrews
*Assistant Examiner* — Yanick A Akaragwe
(74) *Attorney, Agent, or Firm* — Armstrong Teasdale LLP

(57) ABSTRACT

A sensing and communication system for a gas lift well is provided. The gas lift well includes a casing, production tubing positioned within the casing, and a gas lift valve coupled to the production tubing. The sensing and communication system includes a turbine configured to rotate in response to an injected gas stream flowing through the turbine, wherein the turbine is positioned one of i) within an annulus defined between the production tubing and the casing and ii) within the gas lift valve, an alternator coupled to the turbine and configured to generate electrical power from rotation of the turbine, and at least one sensor coupled to the alternator and configured to operate using the generated electrical power.

15 Claims, 4 Drawing Sheets

(56) References Cited

U.S. PATENT DOCUMENTS

| | | | | |
|---|---|---|---|---|
| 5,458,200 | A | | 10/1995 | Lagerlef et al. |
| 5,517,464 | A | | 5/1996 | Lerner et al. |
| 5,586,083 | A | | 12/1996 | Chin et al. |
| 5,730,219 | A | | 3/1998 | Tubel et al. |
| 5,839,508 | A | * | 11/1998 | Tubel ..... E21B 41/0085 166/65.1 |
| 5,960,883 | A | | 10/1999 | Tubel et al. |
| 6,192,983 | B1 | | 2/2001 | Neuroth et al. |
| 6,554,074 | B2 | | 4/2003 | Longbottom |
| 7,322,410 | B2 | | 1/2008 | Vinegar et al. |
| 7,834,777 | B2 | | 11/2010 | Gold |
| 8,033,328 | B2 | | 10/2011 | Hall et al. |
| 8,151,905 | B2 | | 4/2012 | Song |
| 8,242,928 | B2 | | 8/2012 | Prammer |
| 8,469,084 | B2 | | 6/2013 | Clark et al. |
| 2002/0121377 | A1 | | 9/2002 | Longbottom |
| 2005/0012340 | A1 | | 1/2005 | Cousins |
| 2005/0139393 | A1 | | 6/2005 | Maurer et al. |
| 2010/0177596 | A1 | | 7/2010 | Fink et al. |
| 2014/0069724 | A1 | | 3/2014 | Amsellen |
| 2015/0109886 | A1 | | 4/2015 | Mekic et al. |
| 2016/0291189 | A1 | | 10/2016 | Collins |

OTHER PUBLICATIONS

International Search Report and Written Opinion issued in connection with corresponding PCT Application No. PCT/US2018/032876 dated Sep. 13, 2018; 4 pp.

* cited by examiner

METHODS AND SYSTEMS FOR DOWNHOLE SENSING AND COMMUNICATIONS IN GAS LIFT WELLS

BACKGROUND

The field of the invention relates generally to gas lift wells, and more specifically, to methods and systems for downhole sensing and communications in a gas lift well.

Gas lift uses the injection of gas into a production well to increase the flow of liquids, such as crude oil or water, from the production well. Gas is injected down the casing and ultimately into the tubing of the well at one or more downhole locations to reduce the weight of the hydrostatic column. This effectively reduces the density of the fluid in the well and further reduces the back pressure, allowing the reservoir pressure to lift the fluid out of the well. As the gas rises, the bubbles help to push the fluid ahead. The produced fluid can be oil, water, or a mix of oil and water, typically mixed with some amount of gas.

In production wells, downhole sensing equipment (e.g., temperature and pressure sensors) may be used below the surface to monitor conditions below the surface. Power must generally be supplied to the downhole sensing equipment, and data generally must be communicated from the downhole sensing equipment to the surface. At least some known production wells use one or more cables that extend from the surface through the production well to the downhole sensing equipment. However, these cables may be relatively expensive (e.g., if the downhole equipment is located deep within the production well), may break (interrupting power and communication capabilities), and may physically interfere with other components in the production well (e.g., pipes, conduits, mandrels, etc.). Accordingly, it would be desirable to wirelessly provide power and communications between surface equipment and downhole sensing equipment in a production well.

BRIEF DESCRIPTION

In one aspect, a sensing and communication system for a gas lift well is provided. The gas lift well includes a casing, production tubing positioned within the casing, and a gas lift valve coupled to the production tubing. The sensing and communication system includes a turbine configured to rotate in response to an injected gas stream flowing through the turbine, wherein the turbine is positioned one of i) within an annulus defined between the production tubing and the casing and ii) within the gas lift valve, an alternator coupled to the turbine and configured to generate electrical power from rotation of the turbine, and at least one sensor coupled to the alternator and configured to operate using the generated electrical power.

In a further aspect, a gas lift well is provided. The gas lift well includes a casing, production tubing positioned within the casing, a gas lift valve coupled to the production tubing, and a sensing and communication system. The sensing and communication system includes a turbine configured to rotate in response to an injected gas stream flowing through the turbine, wherein the turbine is positioned one of i) within an annulus defined between the production tubing and the casing and ii) within the gas lift valve, an alternator coupled to the turbine and configured to generate electrical power from rotation of the turbine, and at least one sensor coupled to the alternator and configured to operate using the generated electrical power.

In another aspect, a method of assembling a sensing and communication system for a gas lift well that includes a casing, production tubing positioned within the casing, and a gas lift valve coupled to the production tubing is provided. The method includes positioning a turbine one of i) within an annulus defined between the production tubing and the casing and ii) within the gas lift valve, the turbine configured to rotate in response to an injected gas stream flowing through the turbine, coupling an alternator to the turbine, the alternator configured to generate electrical power from rotation of the turbine, and coupling at least one sensor to the alternator, the at least one sensor configured to operate using the generated electrical power.

DRAWINGS

These and other features, aspects, and advantages of the present disclosure will become better understood when the following detailed description is read with reference to the accompanying drawings in which like characters represent like parts throughout the drawings, wherein.

Figure 1:
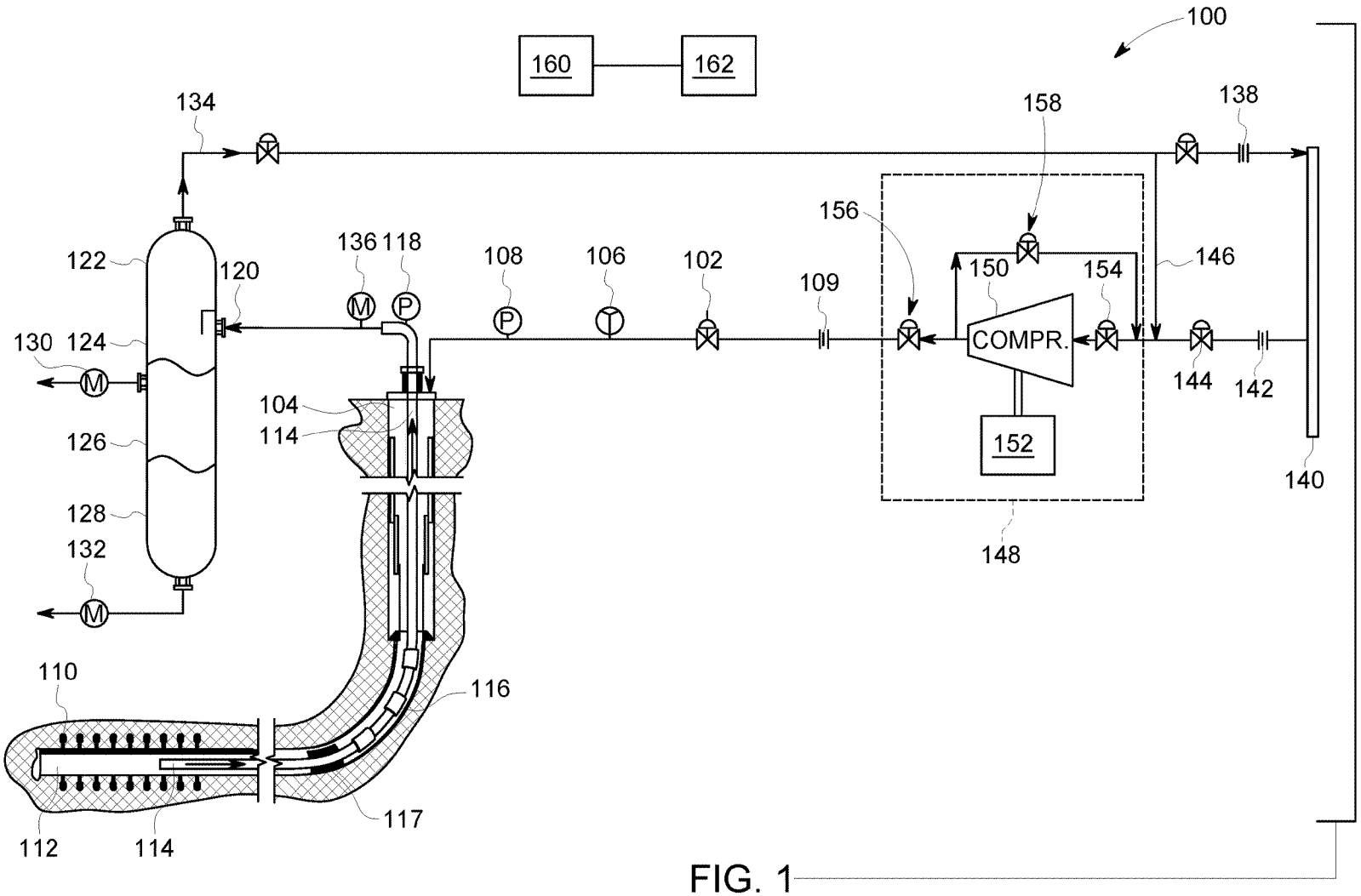
FIG. 1 is a schematic diagram of an exemplary gas lift system.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that may permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and interchanged; such ranges are identified and include all the sub-ranges contained therein unless context or language indicates otherwise.

As used herein, the terms "processor" and "computer" and related terms, e.g., "processing device", "computing device", and "controller" are not limited to just those integrated circuits referred to in the art as a computer, but broadly refers to a microcontroller, a microcomputer, a programmable logic controller (PLC), a programmable logic unit (PLU), an application specific integrated circuit, and other programmable circuits, and these terms are used interchangeably herein. In the embodiments described herein, memory may include, but is not limited to, a computer-readable medium, such as a random access memory (RAM), and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

Further, as used herein, the terms "software" and "firmware" are interchangeable, and include any computer program stored in memory for execution by personal computers, workstations, clients and servers.

As used herein, the term "non-transitory computer-readable media" is intended to be representative of any tangible computer-based device implemented in any method or technology for short-term and long-term storage of information, such as, computer-readable instructions, data structures, program modules and sub-modules, or other data in any device. Therefore, the methods described herein may be encoded as executable instructions embodied in a tangible, non-transitory, computer readable medium, including, without limitation, a storage device and a memory device. Such instructions, when executed by a processor, cause the processor to perform at least a portion of the methods described herein. Moreover, as used herein, the term "non-transitory computer-readable media" includes all tangible, computer-readable media, including, without limitation, non-transitory computer storage devices, including, without limitation, volatile and nonvolatile media, and removable and non-removable media such as a firmware, physical and virtual storage, CD-ROMs, DVDs, and any other digital source such as a network or the Internet, as well as yet to be developed digital means, with the sole exception being a transitory, propagating signal.

Furthermore, as used herein, the term "real-time" refers to at least one of the time of occurrence of the associated events, the time of measurement and collection of predetermined data, the time to process the data, and the time of a system response to the events and the environment. In the embodiments described herein, these activities and events occur substantially instantaneously.

The systems and methods described herein provide power and communications for downhole sensing equipment. These methods and systems use an injected gas flow to rotate a downhole turbine, generating power for downhole sensing equipment. Further, communication between the downhole sensing equipment and the surface is accomplished by transmitting acoustic signals through the injected gas flow. Also, the system and methods described herein are not limited to any single type of gas lift system or type of well, but may be implemented with any gas lift system that is configured as described herein. By wirelessly providing power and communications between downhole components and the surface, the systems and methods described herein eliminate the need to run power and communication cables down through a gas lift well.

FIG. 1 is a schematic diagram of an exemplary gas lift system 100. Gas lift system 100 includes a gas injection control valve 102 which regulates a quantity of gas injected into a well 104. In the exemplary embodiment, well 104 is a hole drilled for extracting fluid, such as crude oil, water, or gas, from the ground. The gas is injected into well 104 and proceeds downhole. While the gas is being injected, an injection temperature sensor 106, an injection pressure sensor 108, and a gas injection meter 109 take measurements at the surface. The injected gas induces a reduction in the density of one or more fluids 110 in well 104, so that the reservoir pressure 112 can be sufficient to push fluids 110 up a tubing 114. In the exemplary embodiment, fluids 110 are a mix of oil, water, and gas. One or more gas lift valves 116 assist the flow of fluids 110 up tubing 114. In some embodiments, downhole temperature and pressure sensors 117 take measurements at downhole locations.

At the top of well 104, a flow tube pressure sensor 118 measures the wellhead tubing pressure. A flow line 120 channels fluids 110 to a separator 122. Separator 122 separates fluid 110 into gas 124, oil, 126, and water 128. Oil 126 is removed by separator 122 and the amount of oil retrieved is metered by oil meter 130. Water 128 is also removed by separator 122 and the amount of water retrieved is metered by water meter 132. Gas 124 is siphoned out of separator 122 through gas line 134. In some embodiments, multi-phase flow meter 136 replaces oil meter 130 and water meter 132. In these embodiments, a multi-phase flow meter 136 is used to measure production. Some gas 124 is transferred to a gas pipeline 140 through a gas production meter 138. In the exemplary embodiment, some gas 124 is transferred to a compressor 148 though a flow line 146.

In some embodiments, such as when there is not enough gas pressure to inject into well 104, gas 124 may be obtained and purchased from gas pipeline 140 through a buy back valve 144 and measured by a buy back meter 142. This may also occur when initially placing well 104 into service or restarting well 104 after down time.

Gas 124 enters compressor 148 through compressor suction valve 154. In the exemplary embodiment, compressor 148 includes a compressor motor 150. Compressor 148 compresses gas 124, and a compressor controller 152 regulates the speed of compressor motor 150. In some embodiments, the speed of compressor motor 150 is measured in regulating the revolutions per minute (RPM) of compressor motor 150. A compressor back pressure valve 156 ensures sufficient discharge pressure for the well and recycles excessive gas back to the compressor suction valve 154. A compressor recycle valve 158 is an overflow valve that reintroduces gas 124 above a certain pressure back into compressor 148 through compressor suction valve 154. Gas 124 flows from compressor 148 to well 104. The amount of gas that is injected into well 104 is measured by gas injection meter 109.

During normal operation of gas lift system 100, gas 124 is compressed by compressor 148. The amount of gas 124 injected into well 104 is controlled by gas injection control valve 102 and measured by gas injection meter 109. In well 104, gas 124 mixes with fluids 110. The mixture of fluids 110 and gas 124 is pushed up through tubing 114 to the top of well 104 by reservoir pressure 112. The mixture of gas 124 and fluids 110 travels through flow line 120 into separator 122, where fluids 110 and gas 124 are separated.

A quantity of gas 124 is routed back to compressor 148 to be reinjected into well 104. Excess gas 124 is routed to gas pipeline 140 to be sold or otherwise used elsewhere. In some embodiments, some gas 124 is used to power compressor motor 150.

In the exemplary embodiment, gas lift system 100 includes a surface decoder 160 installed at the surface of gas lift system 100. Surface decoder 160 receives signals from one or more downhole communication systems located in well 104, as described herein. Surface decoder 160 processes the received signals (e.g., by decrypting or converting the information therein) and generates one or more outputs based on the processed signals. The outputs may, for example, cause information to be displayed on a display device 162 communicatively coupled to surface decoder 160 for viewing by a human operator.

Figure 2:
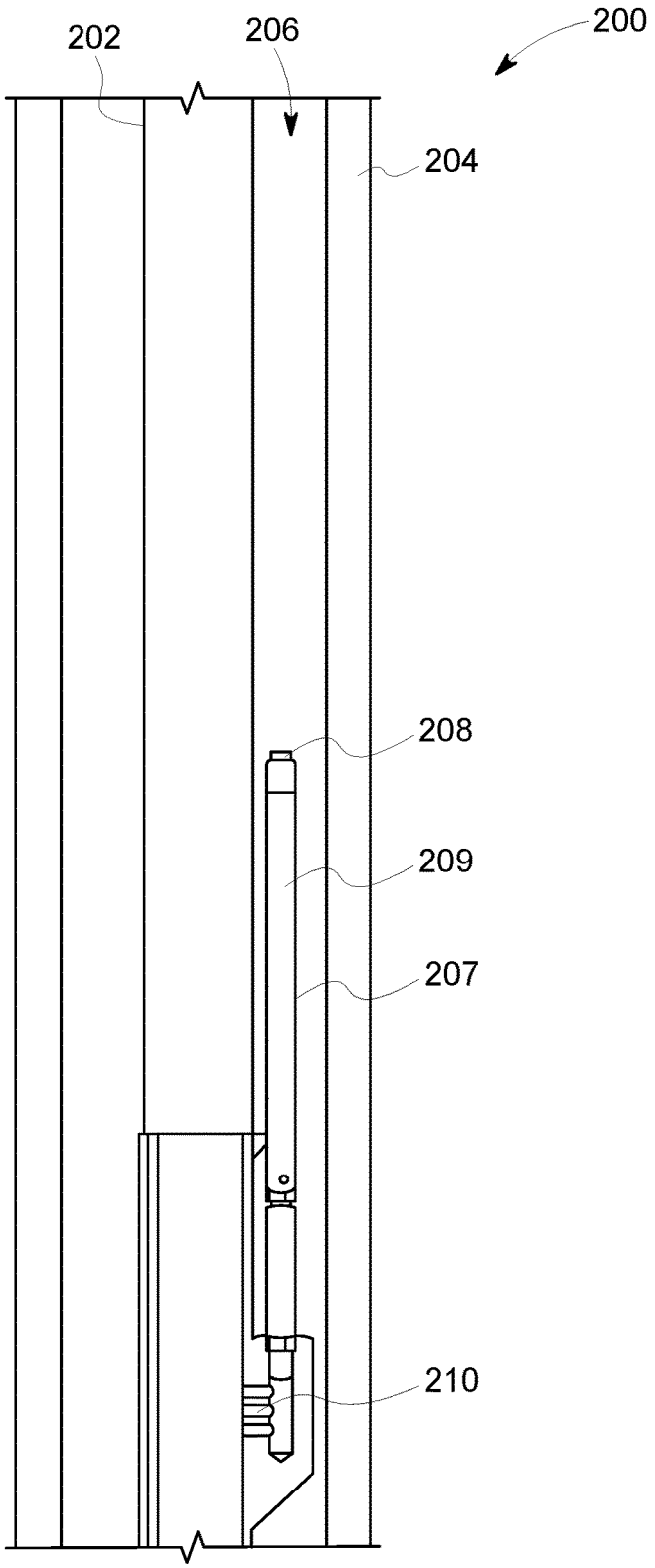
FIG. 2 is a schematic diagram of a portion of an exemplary gas lift well that may be used with the system shown in FIG. 1.

FIG. 2 is a schematic diagram of a portion of an exemplary gas lift well 200, such as well 104 (shown in FIG. 1). Well 200 includes production tubing 202, such as tubing 114 (shown in FIG. 1) that extends through a casing 204. An annulus 206 is defined between production tubing 202 and casing 204. Further, as shown in FIG. 2, in the exemplary embodiment, a gas lift mandrel 207 including a gas lift valve 209 is coupled to production tubing 202. Alternatively, gas lift mandrel 207 may be a side pocket mandrel, such that gas lift valve 209 is positioned within production tubing 202. Although a single gas lift mandrel 207 is shown in FIG. 2, those of skill in the art will appreciate that well 200 may include a plurality of gas lift mandrels 206. Further, as used herein, a 'gas lift valve' includes any gas lift valve in a gas lift well, including gas lift valves that only include a gas port. Gas lift mandrel 207 provides flow communication between annulus 206 and production tubing 202 to facilitates operation of well, as described herein. Specifically, gas lift mandrel 207 includes a gas entry port 208 that provides flow communication between annulus 206 and gas lift valve 209, and orifices 210 that provide flow communication between gas lift valve 209 and production tubing 202.

Initially, annulus 206 is filled with a completion fluid. Subsequently, gas is injected into annulus 206, creating a gas column that gradually lowers the level of completion fluid in annulus 206. Once the level of completion fluid falls below gas entry port 208, the injected gas flows into gas lift mandrel 207. Further, once the level of completion fluid falls below orifices 210, gas flows from gas lift mandrel 207 into production tubing 202. The injected gas induces a reduction in the density of one or more fluids in production tubing 202, so that a reservoir pressure pushes the one or more fluids up production tubing 202.

Figure 3:
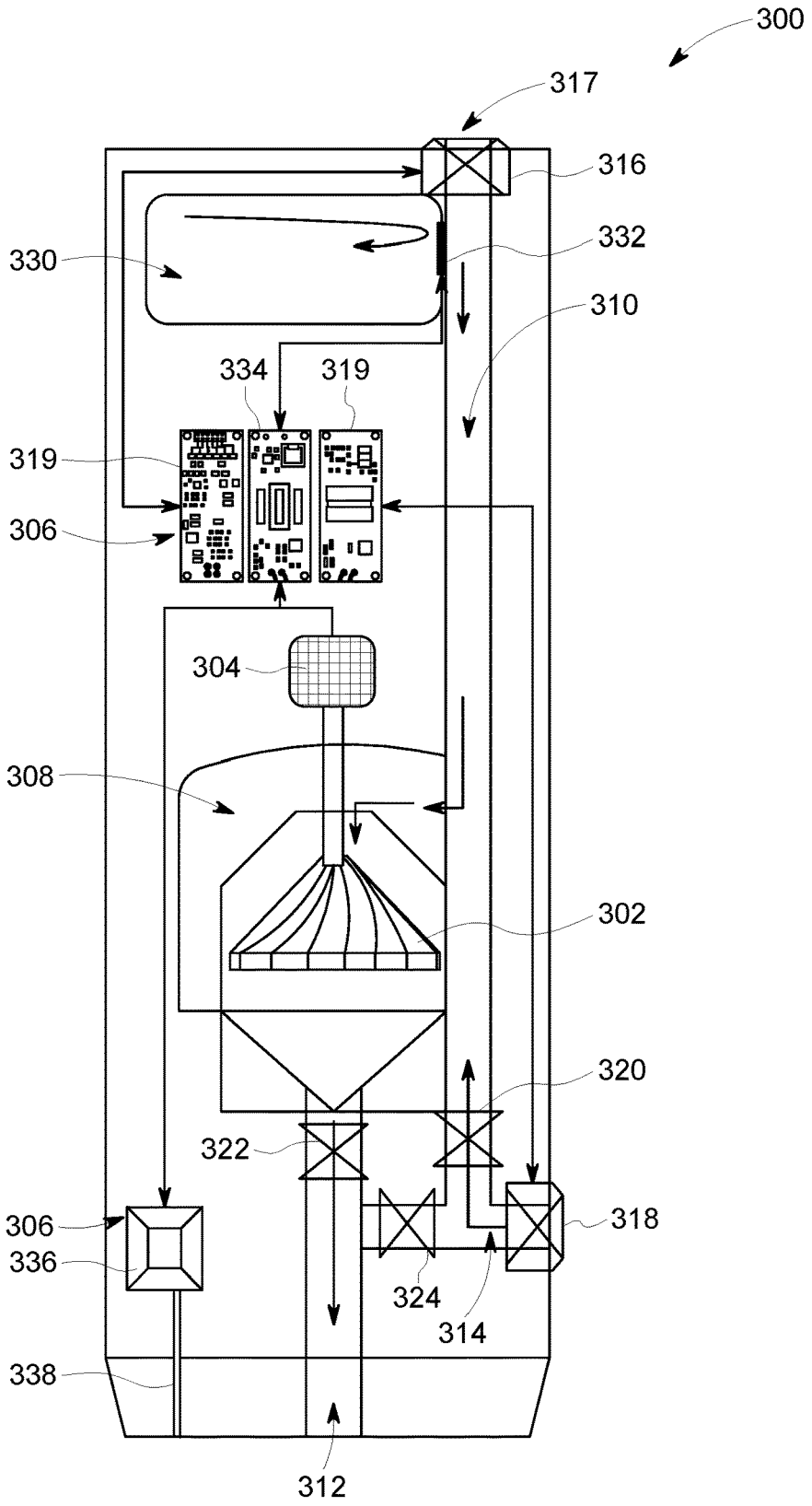
FIG. 3 is a schematic diagram of an exemplary sensing and communication system that may be used with the gas lift well shown in FIG. 2.

FIG. 3 is a schematic diagram of an exemplary sensing and communication system 300 that may be used with well 200 (shown in FIG. 2). In the exemplary embodiment, system 300 is contained within gas lift valve 209 (shown in FIG. 2). Alternatively, system 300 may be located in any portion of well 200 that enables system 300 to function as described herein.

As shown in FIG. 3, system 300 includes a turbine 302 coupled to an alternator 304 that provides power to sensing and signaling electronics 306. As used herein, a 'turbine' refers to any generator, mechanism, or device operable to extract mechanical energy from a fluid flow through the device. For example, turbine 302 may include any suitable arrangement of blades and/or vanes that facilitate extracting mechanical energy from the fluid flow. In addition, as used herein, an 'alternator' refers to any generator, mechanism, or device operable to convert mechanical energy into electrical energy. For example, alternator 304 may include a linear alternator, a stationary armature with a rotating magnetic field, a stationary magnetic field with a rotating armature, etc. In the exemplary embodiment, turbine 302 is located in a turbine chamber 308 that is in flow communication with a first conduit 310. Turbine chamber 308 is also in flow communication with a second conduit 312 that leads to orifices 210. Further, a third conduit 314 is in flow communication with first and second conduits 310 and 312.

A first valve 316 controls flow communication between annulus 206 and first conduit 310. First valve 316 is located at a gas entry port 317 (e.g., gas entry port 208 (shown in FIG. 2). A second valve 318 controls flow communication between annulus 206 and third conduit 314. In the exemplary embodiment, sensing and signaling electronics 306 include valve controllers 319 communicatively coupled to first and second valves 316 and 318 such that valve controllers 319 are able to control operation (e.g., opening and closing) of first and second valves 316 and 318.

As shown in FIG. 3, system 300 further includes a third valve 320 controlling flow communication between first conduit 310 and third conduit 314, a fourth valve 322 controlling flow communication between turbine chamber 308 and second conduit 312, and a fifth valve 324 controlling flow communication between second conduit 312 and third conduit 314. Valves 316, 318, 320, 322, and 324 may be, for example, ball valves, check valves, gate valves, or any other type of valve that enables system 300 to function as described herein.

System 300 further includes a resonator chamber 330 and a flapper 332 that controls flow communication between resonator chamber 330 and first conduit 310. Specifically, when flapper 332 is open, resonator chamber 330 is in flow communication with first conduit 310. When flapper 332 is closed, resonator chamber 330 is not in flow communication with first conduit 310. The position of flapper 332 (i.e., open or closed) is controlled by a flapper controller 334, which is included in sensing and signaling electronics 306 in the exemplary embodiment. Resonator chamber 330 and flapper 332 facilitate communicating information from system 300 to a surface communications system, such as surface decoder 160 (shown in FIG. 1), as described in detail herein. In an alternative embodiment, resonator chamber 330 could function as a bypass port. Specifically, resonator chamber 330 may be in fluid communication with production tubing 202 such that when flapper 332 is opened, gas flows through resonator chamber 330 into production tubing 202, bypassing turbine 302. When flapper 332 is closed, gas flows through turbine 302.

In the exemplary embodiment, sensing and signaling electronics 306 further include a pressure sensor 336. Pressure sensor 336 is in communication with a pressure port 338 to facilitate measuring, for example, a pressure within gas lift mandrel 207 and/or production tubing 202. Sensing and signaling electronics 306 may also include other sensors, such as, for example, temperature sensors, position determination sensors (e.g., ultrasonic sensors), accelerometers, flow sensors (e.g., acoustic flow sensors), fluid property sensors, conductivity sensors, salinity sensors, microwave water-cut sensors, vortex flow sensors, nuclear densometers, etc.

During operation, turbine chamber 308 and first, second, and third conduits 310, 312, and 314 are initially filled with completion fluid, and flapper 332 is closed (such that resonator chamber 330 does not include any fluid). As gas is injected into gas lift valve 209 through second valve 318, the completion fluid is pushed out of gas lift valve 209. Once the level of completion fluid falls below second valve 318, gas also flows into third conduit 314. Once turbine chamber 308 is purged of completion fluid, the injected gas flows though turbine 302 and causes turbine 302 to rotate, powering sensing and signaling electronics 306. After turbine 302 has stabilized, first valve 316 opens, allowing gas to enter through gas entry port 317 while third valve 320 is closed.

In the exemplary embodiment, fifth valve 324 is closed during normal operation, preventing flow directly between third conduit 314 and second conduit 312. However, if turbine 302 fails, fifth valve 324 opens, bypassing flow through turbine 302 by allowing direct flow between third conduit 314 and second conduit 312. Fifth valve 324 may be opened, for example, using a solenoid (not shown) that is not powered by operation of turbine 302.

As indicated above, resonator chamber 330 and flapper 332 facilitate communicating information from system 300 to surface decoder 160 (shown in FIG. 1). Specifically, resonator chamber 330 generates an acoustic tone when flapper 332 is open and gas flows through first conduit 310. Further, resonator chamber 330 does not generate an acoustic tone when flapper 332 is closed. Accordingly, by selectively opening and closing flapper 332 (e.g., using flapper controller 334) a series or pattern of tones can be generated. Alternatively, the frequency of a tone generated by resonator chamber 330 may be modulated by opening or closing a valve, or changes the dimensions of resonator chamber 330 (e.g., using a piston or other suitable mechanism).

The tones generated by resonator chamber 330 are acoustically carried upward to surface decoder 160 through the injected gas stream. Accordingly, information may be communicated from system 300 to surface decoder 160 using acoustic signals generated by resonator chamber 330. Surface decoder 160 may include, for example, a high pressure microphone or pressure transducer for detecting the acoustic signals. The microphone may be located in the injection gas line, and may be mechanically isolated from surface piping to prevent surface noise from contaminating the detected acoustic signals. To decode the detected acoustic signals, surface decoder 160 filters, digitizes, and processes the detected acoustic signals. The decoded signals may then be transferred to display device 162 for display, or to a data management system for further analysis, storage, and/or transmission.

In one embodiment, an on/off keyed (OOK) communication is used to communicate information through the acoustic signals. Alternatively, any suitable communication scheme may be used. For example, any suitable time, frequency, or phase based modulation scheme, including their derivatives (e.g., amplitude shift key (ASK), OOK, frequency shift key (FSK), phase shift key (PSK), quadrature amplitude modulation (QAM), quadrature frequency-division multiplexing (QFDM), etc.) may be used. System 300 can also receive (e.g., at sensing and signaling electronics 306) acoustic signals transmitted through the injected gas stream from the surface. Accordingly, system 300 facilitates two-way communications.

Figure 4:
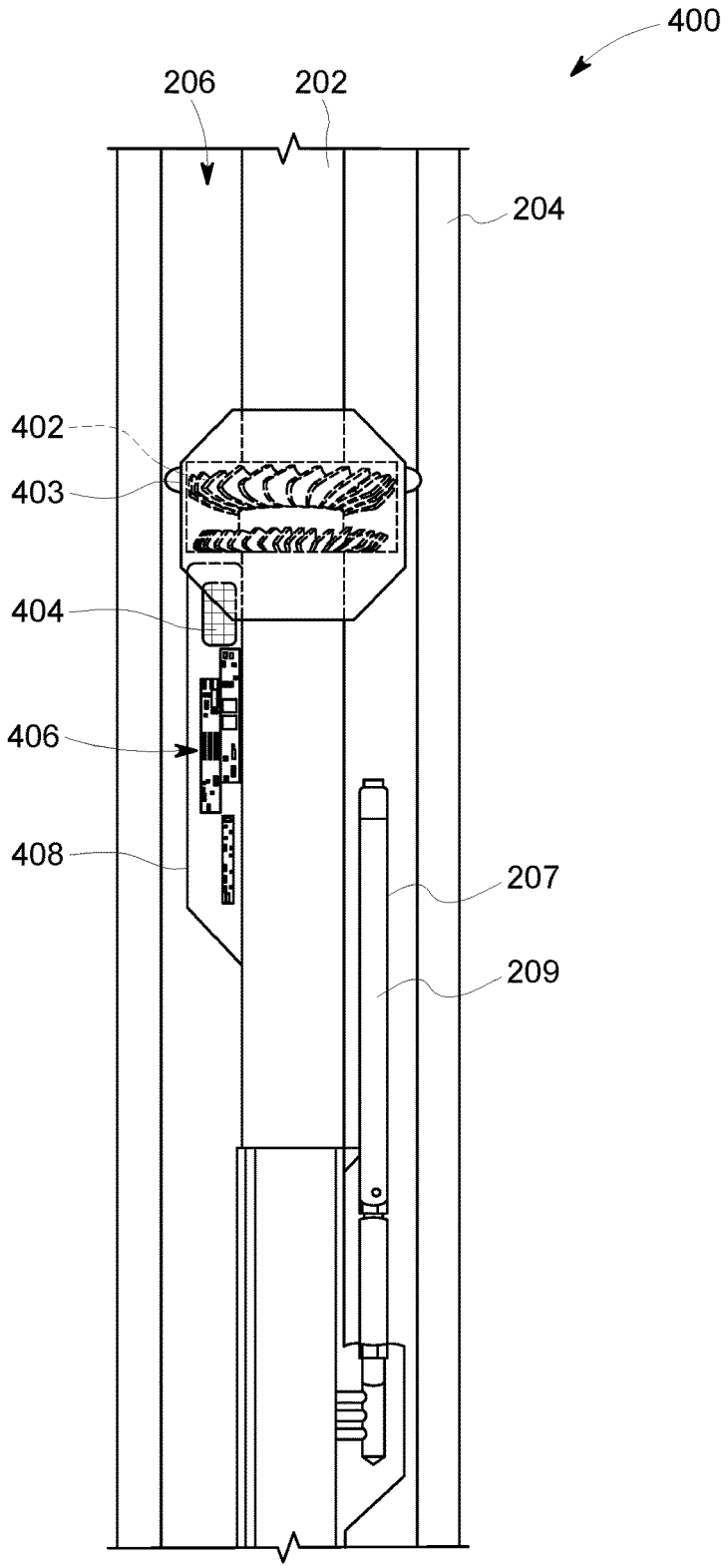
FIG. 4 is a schematic diagram of an alternative exemplary sensing and communication system that may be used with the gas lift well shown in FIG. 2.

FIG. 4 is a schematic diagram of an alternative embodiment of an exemplary sensing and communication system 400 that may be used with well 200 (shown in FIG. 2). As shown in FIG. 4, in contrast to system 300 (shown in FIG. 3), system 400 is not located within gas lift mandrel 207 or gas lift valve 209.

Instead, in the exemplary embodiment, system 400 includes a turbine 402 located in annulus 206. That is, turbine 402 substantially circumscribes production tubing 202. Further, a wiper seal 403 is coupled between turbine 402 and casing 204. Turbine 402 is coupled to an alternator 404 (similar to alternator 304 (shown in FIG. 3) that provides power to sensing and signaling electronics 406 (similar to sensing and signaling electronics 306 (shown in FIG. 3). In the exemplary embodiment, alternator 404 and sensing and signaling electronics 406 are located in a housing 408 coupled to production tubing 202. Alternatively, alternator 404 and sensing and signaling electronics 406 may have any location that enables system 400 to function as described herein. Sensing and signaling electronics 406 may also include other sensors, such as, for example, temperature sensors, position determination sensors (e.g., ultrasonic sensors), etc.

Injected gas flow through annulus 206 rotates turbine 402, powering sensing and signaling electronics 406. In this embodiment, information is communicated from system 400 to surface decoder 160 (shown in FIG. 1) using acoustic signals generated by rotation of turbine 402. Specifically, the injected gas flow is controlled such that turbine 402 rotates at a predetermined number of revolutions per minute (RPM). Further, turbine 402 includes rotor apertures and/or stator apertures arranged such that turbine 402 makes a continuous whistling sound or siren sound in a specific frequency range when turbine 402 is rotating at the predetermined RPM.

If a load on turbine 402 is reduced, turbine 402 rotates faster, increasing the frequency of the whistling. Further, if the load on turbine 402 is increased, turbine 402 rotates slower, decreasing the frequency of the whistling. Accordingly, by controlling the load on turbine 402, the frequency of the acoustic signal generated by turbine 402 (i.e., the whistling) can be controlled. In the exemplary embodiment, the load on turbine 402 is adjusted by restricting (e.g., braking) or freeing movement of alternator 404. Alternatively, the load on turbine 402 may be adjusted using any technique that enables system 400 to function as described herein. In some embodiments, a separate motor could also be used to control a rotary valve siren to constrict the flow generating the desired frequencies. In such embodiments, alternator 404 supplies power to an electrical system that drives the motor controlling the siren at a rate independent of alternator 404.

The acoustic signals generated by rotation of turbine 402 are acoustically carried upward to surface decoder 160 through the injected gas stream. Accordingly, information may be communicated from system 400 to surface decoder 160 using acoustic signals generated by turbine 402. Surface decoder 160 may include, for example, a high pressure microphone or pressure transducer for detecting the acoustic signals. The microphone may be located in the injection gas line, and may be mechanically isolated from surface piping to prevent surface noise from contaminating the detected acoustic signals. To decode the detected acoustic signals, surface decoder 160 filters, digitizes, and processes the detected acoustic signals. The decoded signals may then be transferred to display device 162 for display, or to a data management system for further analysis, storage, and/or transmission.

In one embodiment, a frequency shift key (FSK) communication scheme is used to communicate information through the acoustic signals. Alternatively, any suitable communication scheme may be used. System 400 can also receive (e.g., at sensing and signaling electronics 406) acoustic signals transmitted through the injected gas stream from the surface. Accordingly, system 400 facilitates two-way communications. Further, communication can be accomplished by modulating a velocity of the gas flow, changing the RPM of turbine 402, and/or sending acoustic waves through the gas flow to a pressure transducer.

Using systems 300 and 400, power is generated for downhole equipment by rotating a turbine using an injected gas stream. Further, using system 300 and 400, data is communicated by acoustic signals traveling through the injected gas stream. Accordingly, systems 300 and 400 eliminate the need for one or more cables in a gas lift well to provide power to downhole equipment, and to provide communications between downhole equipment and the surface.

This disclosure also enables methods for assembling and operating the sensing and communication systems described herein. For example, in an exemplary embodiment, a method of assembling a sensing and communication system includes positioning a turbine one of i) within an annulus and ii) within a gas lift valve, the turbine configured to rotate in response to an injected gas stream flowing through the turbine. The exemplary method further includes coupling an alternator to the turbine, the alternator configured to generate electrical power from rotation of the turbine, and coupling at least one sensor to the alternator, the at least one sensor configured to operate using the generated electrical power.

The above-described systems and methods provide power and communications for downhole sensing equipment. These methods and systems use an injected gas flow to rotate a downhole turbine, generating power for downhole sensing equipment. Further, communication between the downhole sensing equipment and the surface is accomplished by transmitting acoustic signals through the injected gas flow. Also, the system and methods described herein are not limited to any single type of gas lift system or type of well, but may be implemented with any gas lift system that is configured as described herein. By wirelessly providing power and communications between downhole components and the surface, the systems and methods described herein eliminate the need to run power and communication cables down through a gas lift well.

An exemplary technical effect of the methods, systems, and apparatus described herein includes at least one of: (a) providing a self-sustained and self-contained system for communicating data between downhole components and the surface; (b) utilizing an injected gas stream to wirelessly provide power to downhole components; and (c) eliminating obstructions and additional equipment in gas lift wells.

Exemplary embodiments of method and systems for downhole sensing and communications in gas lift wells are described above in detail. The method and systems described herein are not limited to the specific embodiments described herein, but rather, components of systems or steps of the methods may be utilized independently and separately from other components or steps described herein. For example, the methods may also be used in combination with multiple different gas lift system, and are not limited to practice with only the gas lift systems as described herein. Additionally, the methods may also be used with other fluid sources, and are not limited to practice with only the fluid sources as described herein. Rather, the exemplary embodiments may be implemented and utilized in connection with many other gas lift devices to be operated as described herein.

Although specific features of various embodiments may be shown in some drawings and not in others, this is for convenience only. In accordance with the principles of the systems and methods described herein, any feature of a drawing may be referenced or claimed in combination with any feature of any other drawing.

Some embodiments involve the use of one or more electronic or computing devices. Such devices typically include a processor, processing device, or controller, such as a general purpose central processing unit (CPU), a graphics processing unit (GPU), a microcontroller, a reduced instruction set computer (RISC) processor, an application specific integrated circuit (ASIC), a programmable logic circuit (PLC), a programmable logic unit (PLU), a field programmable gate array (FPGA), a digital signal processing (DSP) device, and/or any other circuit or processing device capable of executing the functions described herein. The methods described herein may be encoded as executable instructions embodied in a computer readable medium, including, without limitation, a storage device and/or a memory device. Such instructions, when executed by a processing device, cause the processing device to perform at least a portion of the methods described herein. The above examples are exemplary only, and thus are not intended to limit in any way the definition and/or meaning of the term processor and processing device.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A sensing and communication system for a gas lift well, the gas lift well including a casing, production tubing positioned within the casing, and a gas lift valve coupled to the production tubing, said sensing and communication system comprising:

a turbine configured to rotate in response to an injected gas stream flowing through said turbine, wherein said turbine is positioned in a turbine chamber within the gas lift valve, such that the turbine chamber is in flow communication with a first conduit defined in the gas lift valve;

a resonator chamber; and a flapper for controlling flow communication between the first conduit and said resonator chamber, wherein said resonator chamber generates a tone when said resonator chamber is in flow communication with the first conduit and the injected gas stream flows through the first conduit.

2. The sensing and communication system in accordance with claim 1, wherein said sensing and communication system further comprises:

an alternator coupled to said turbine for generating electrical power from rotation of said turbine; and at least one sensor coupled to said alternator and configured to operate using the generated electrical power.

3. The sensing and communication system in accordance with claim 2, further comprising:

a flapper controller communicatively coupled to said flapper, said flapper controller configured to selectively open and close said flapper to generate an acoustic signal that travels through the injected gas stream.

4. The sensing and communication system in accordance with claim 3, wherein said flapper controller is further configured to operate using the generated electrical power.

5. The sensing and communication system in accordance with claim 3, further comprising a surface decoder configured to detect and process the generated acoustic signal.

6. The sensing and communication system in accordance with claim 1, further comprising a surface decoder configured to detect and process the generated tone.

7. A gas lift well comprising:

a casing;

production tubing positioned within said casing;

a gas lift valve coupled to said production tubing; and a sensing and communication system comprising:

a turbine configured to rotate in response to an injected gas stream flowing through said turbine, wherein said turbine is positioned in a turbine chamber within said gas lift valve, wherein the turbine chamber is in flow communication with a first conduit defined in said gas lift valve;

a resonator chamber; and a flapper for controlling flow communication between the first conduit and said resonator chamber, wherein said resonator chamber generates a tone when said resonator chamber is in flow communication with the first conduit and the injected gas stream flows through the first conduit.

8. The gas lift well in accordance with claim 7, wherein said sensing and communication system further comprises:

an alternator coupled to said turbine and for generating electrical power from rotation of said turbine; and at least one sensor coupled to said alternator and configured to operate using the generated electrical power.

9. The gas lift well in accordance with claim 8, further comprising:

a flapper controller communicatively coupled to said flapper, said flapper controller configured to selectively open and close said flapper to generate an acoustic signal that travels through the injected gas stream.

10. The gas lift well in accordance with claim 9, wherein said flapper controller is further configured to operate using the generated electrical power.

11. The gas lift well in accordance with claim 9, further comprising a surface decoder configured to detect and process the generated acoustic signal.

12. The gas lift well in accordance with claim 7, further comprising a surface decoder configured to detect and process the generated tone.

13. A method of assembling a sensing and communication system for a gas lift well that includes a casing, production tubing positioned within the casing, and a gas lift valve coupled to the production tubing, said method comprising:

positioning a turbine in a turbine chamber within the gas lift valve, the turbine configured to rotate in response to an injected gas stream flowing through the turbine, wherein the turbine chamber is in flow communication with a first conduit defined in the gas lift valve;

coupling a resonator chamber in flow communication with the first conduit; and coupling a flapper between the first conduit and the resonator chamber, the flapper for controlling flow communication between the first conduit and the resonator chamber, where the resonator chamber generates a tone when the resonator chamber is in flow communication with the first conduit and the injected gas stream flows through the first conduit.

14. The method of claim 13, further comprising installing a surface decoder configured to detect an acoustic signal traveling through the injected gas stream.

15. The method of claim 14, wherein installing a surface decoder comprises installing a surface decoder configured to detect an acoustic signal generated by a resonator chamber.

* * * * *